US006619145B2

(12) United States Patent
Hosoya

(10) Patent No.: US 6,619,145 B2
(45) Date of Patent: Sep. 16, 2003

(54) STARTER HAVING PLANETARY GEAR SPEED REDUCTION MECHANISM

(75) Inventor: Akifumi Hosoya, Anjo (JP)

(73) Assignee: Denso Corporation, Kariya (JP)

( * ) Notice: Subject to any disclaimer, the term of this patent is extended or adjusted under 35 U.S.C. 154(b) by 25 days.

(21) Appl. No.: 09/996,780

(22) Filed: Nov. 30, 2001

(65) Prior Publication Data

US 2002/0069711 A1 Jun. 13, 2002

(30) Foreign Application Priority Data

Dec. 8, 2000 (JP) ..... 2000-375051

(51) Int. Cl.[7] ..... F02N 19/34

(52) U.S. Cl. ..... 74/7; 220/4.02

(58) Field of Search ..... 74/7 E, 6, 7 R, 74/7 A, 7 B, 7 C, 7 D, 8, 9; 428/34.1; 206/811; 220/4.02; 310/88, 89

(56) References Cited

U.S. PATENT DOCUMENTS 4,503,719 A * 3/1985 Hamano ..... 74/7 E
4,626,724 A * 12/1986 Morishita et al. ..... 310/88
4,848,172 A * 7/1989 Morishita ..... 74/7 E
4,920,812 A 5/1990 Okamoto et al.
5,101,114 A * 3/1992 Isozumi et al. ..... 290/48
5,267,918 A * 12/1993 Shiroyama ..... 475/331
5,298,824 A * 3/1994 Franz ..... 310/89
5,521,441 A * 5/1996 Shiga et al. ..... 290/48
5,688,203 A * 11/1997 Yamamoto et al. ..... 475/331
5,844,336 A * 12/1998 Ohya et al. ..... 310/80
5,861,691 A * 1/1999 Soh et al. ..... 310/89
5,899,378 A * 5/1999 Hainle et al. ..... 236/34.5
5,905,309 A * 5/1999 Ohmi et al. ..... 290/36 R
5,914,159 A * 6/1999 Kato ..... 428/34.1
6,239,503 B1 * 5/2001 Ikeda et al. ..... 290/38 R
6,462,270 B1 * 10/2002 Depp et al. ..... 174/50

FOREIGN PATENT DOCUMENTS

JP A 7-119598 5/1995

* cited by examiner

*Primary Examiner*—Jack Lavinder
*Assistant Examiner*—Benjamin A Pezzlo
(74) *Attorney, Agent, or Firm*—Oliff & Berridge, PLC

(57) ABSTRACT

A starter is comprised of a starter motor, a planetary gear speed reduction mechanism including a sun gear, a plurality of planetary gears and an internal gear, a casing rotatably supporting the output shaft via a bearing and an outer cylindrical member coupled with the casing. The planetary gear speed reduction mechanism has an internal gear block having the internal gear, and the internal gear block is disposed in the cylindrical member and spline-fitted to the casing. Thus, a labyrinth is formed between the internal gear block and the casing.

9 Claims, 6 Drawing Sheets

STARTER HAVING PLANETARY GEAR SPEED REDUCTION MECHANISM

CROSS REFERENCE TO RELATED APPLICATION

The present application is based on and claims priority from Japanese Patent Application 2000-375051 filed Dec. 8, 2000, the contents of which are incorporated herein by reference.

BACKGROUND OF THE INVENTION

1. Field of the Invention

The present invention relates to a starter that is equipped with a planetary gear speed reduction mechanism.

2. Description of the Related Art

A planetary gear speed reduction mechanism for a starter is comprised of a sun gear, an internal gear and a plurality of planetary gears that engages the internal gear and revolve around the sun gear to transmit the revolution to an output shaft thereof. As shown in FIG. 9, an internal gear block 110 that has an internal gear 100 is prevented from rotating by an outer cylindrical member 130 or the like that is integrated with a yoke 120 of the starter motor. If it rotates, the planetary gear can not revolve around the sun gear.

In a conventional starter having the above stated planetary gear speed reduction mechanism, an end surface of an internal gear block 110 only axially abuts an end surface of a casing 160 that rotatably supports an output shaft 150 via a bearing 140. Therefore, water may leak from the gap between the two members into the inside and reach a portion around the bearing 140. In such a case, the bearing may not operate properly or seize up.

In FIG. 9, the outer cylindrical member 130 is integrated with the yoke 120. If the outer cylindrical member 130 is integrated with the casing 160, water may get into the inside from the gap between the outer cylindrical member 130 and the internal gear block 110.

SUMMARY OF THE INVENTION

The present invention has been made in view of the above problem, and an object of the invention is to prevent water from leaking between the internal gear block and the casing.

According to a main feature of the invention, a starter includes a starter motor, a planetary gear speed reduction mechanism, a casing rotatably supporting an output shaft of the speed reduction mechanism and an outer cylindrical member coupled the said casing. The planetary gear speed reduction mechanism has an internal gear block in which the internal gear is formed. The internal gear block is disposed inside the cylindrical member and spline-fitted to the casing, thereby forming a labyrinth between the internal gear block and said casing.

Therefore, the casing and the outer cylindrical member are sealed to be watertight, and the internal gear block is prevented from rotating by the spline arrangement or a rotation stopper disposed between the internal gear block and the casing.

In other words, the rotation stopper is disposed at a portion of the outer periphery of the internal gear that does not overlap the internal gear in the axial direction thereof. Accordingly, deformation of the rotation stopper may not cause the internal gear any trouble.

According to another feature of the invention, the starter may be comprised of a shock absorber having a rotary disk that rotates when a torque larger than a predetermined torque is applied thereto. In this case, the water sealing labyrinth prevents water from reaching the shock absorber, particularly, to the rotary disk. Therefore, the lifetime of the shock absorber can be improved.

BRIEF DESCRIPTION OF THE DRAWINGS

Other objects, features and characteristics of the present invention as well as the functions of related parts of the present invention will become clear from a study of the following detailed description, the appended claims and the drawings. In the drawings:

DETAILED DESCRIPTION OF THE PREFERRED EMBODIMENTS

The invention will be described with reference to the appended drawings hereafter.

Figure 1:
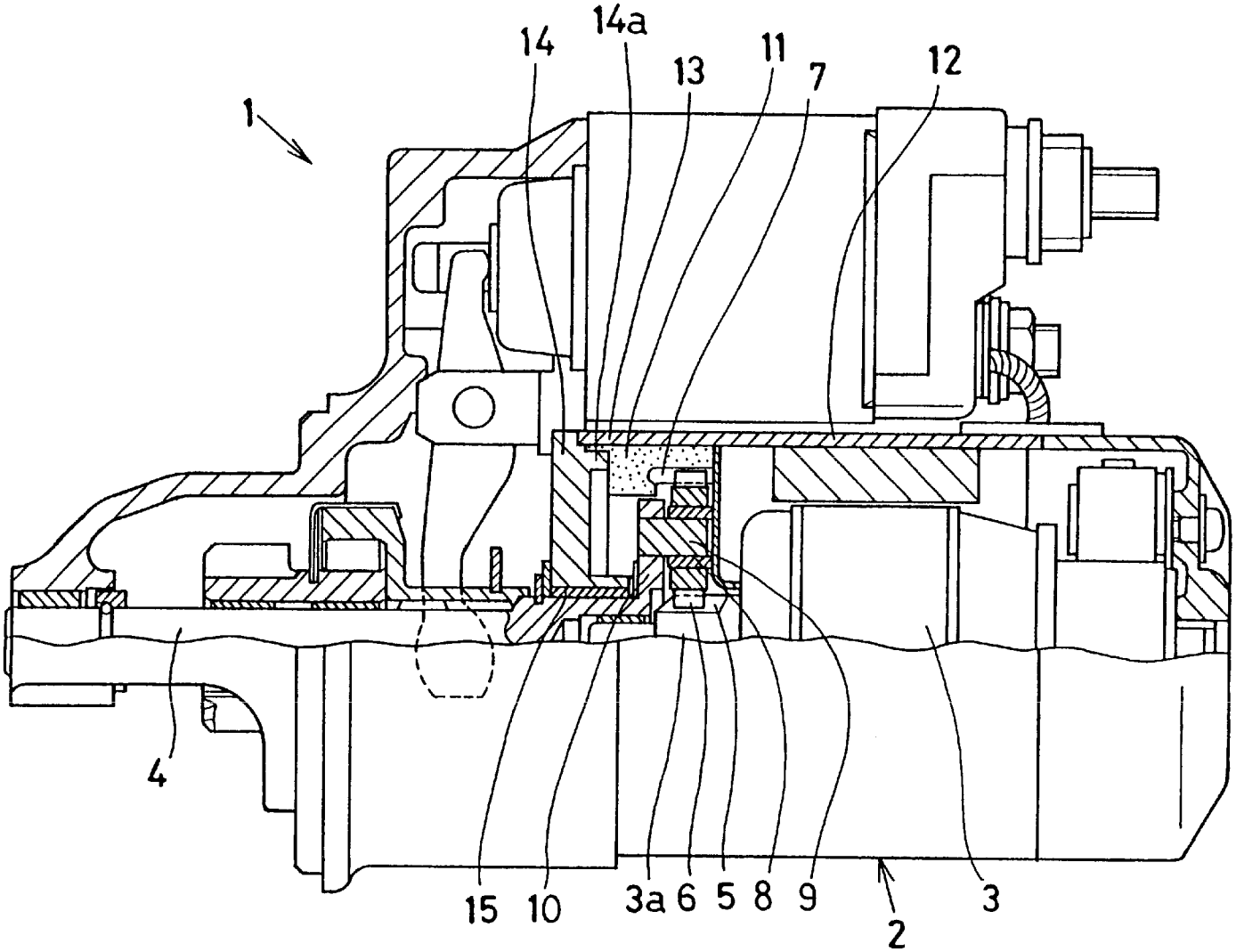
FIG. 1 is a partially cross-sectional side view of a starter according to a preferred embodiment of the invention.

As shown in FIG. 1, a starter 1 is comprised of a starter motor 2 and a speed reduction mechanism which reduces rotation of an armature 3 of the starter motor 2 and transmits the rotation to an output shaft 4, which is transmitted to a pinion to be engaged with a ring gear of an engine.

The speed reduction mechanism is a well-known mechanism that is comprised of a sun gear 5 formed on an armature shaft 3*a*, a plurality of planetary gears 6 in engagement with the sun gear 5 and an internal gear 7 in engagement with the planetary gears 6. That is, the revolution of the plurality of planetary gears is transmitted to the output shaft 4.

Each planetary gear 6 is rotatably supported by a carrier pin 9 via a bearing 8, and the carrier pin 9 is force-fitted into a planet carrier 10. The internal gear 7 is disposed inside a cylindrical internal gear block 11 so that the plurality of plurality of planetary gears 6 engage the internal gear 7.

The internal gear block 11 is disposed to slide on the inner surface of an outer cylindrical member 13, which is integrated with the yoke 12 of the starter motor 2, in the circumferential direction thereof. The internal gear block 11 is prevented from rotating by a spline arrangement as a rotation stopper disposed between the internal gear block 11 and a casing 14.

Figure 3:
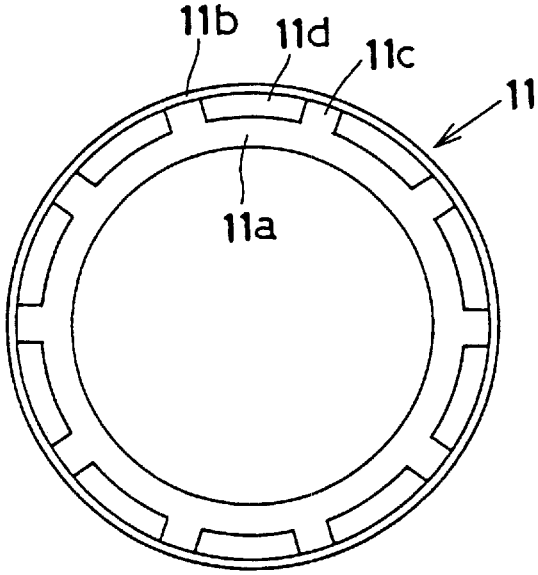
FIG. 3 is a front view of a internal gear block viewed from point III of the speed reduction mechanism shown in FIG. 4.

As shown in FIG. 3, the internal gear block 11 has a ring-shaped surface 11*a* that faces in the axial direction toward the casing 14. A cylindrical projecting portion 11*b* projects in the axial direction from the peripheral portion of the surface 11*a*.

A plurality of medium portions lid is formed in the circumferential direction on the inner surface of the cylindrical projecting portion 11*b*, so that a plurality of spline grooves 11*c* is formed among the medium portions along the inner wall of the projecting portion 11*b*. The height of the medium portions or the spline grooves is lower than the projecting portion 11*b*. In other words, the cylindrical projecting portion 11*b* is formed at the periphery of the internal gear block 11, and the plurality of spline grooves 11*c* are formed along the inner surface of the cylindrical projecting portion.

Figure 2:
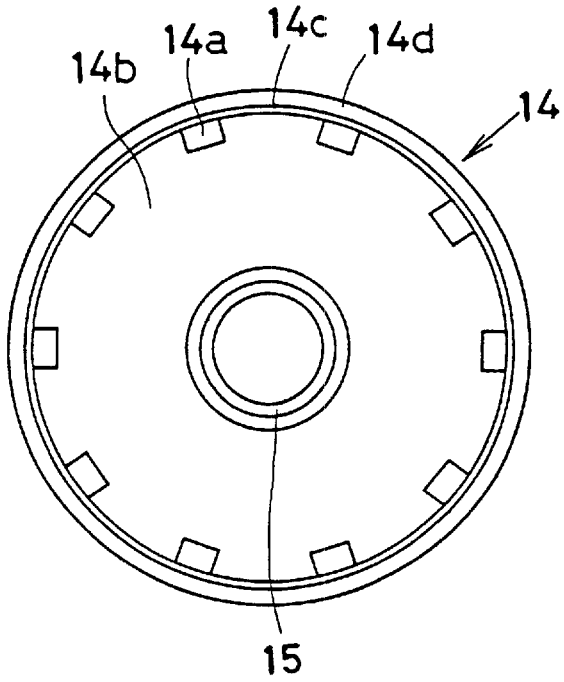
FIG. 2 is a front view of a casing viewed from position II of a speed reduction mechanism shown in FIG. 4.

As shown in FIGS. 1 and 2, the casing 14 rotatably supports the output shaft 4 and covers an end of the speed reduction mechanism remote from the motor, together with the outer cylindrical member 13. The casing 14 has axially thickening circular steps and a plurality of axially projecting spline teeth 14*a* at the peripheral portion thereof.

The spline teeth 14*a* are formed at the surface of a base step 14*b*, which faces the speed reduction mechanism, at circumferentially equal intervals.

Figure 4:
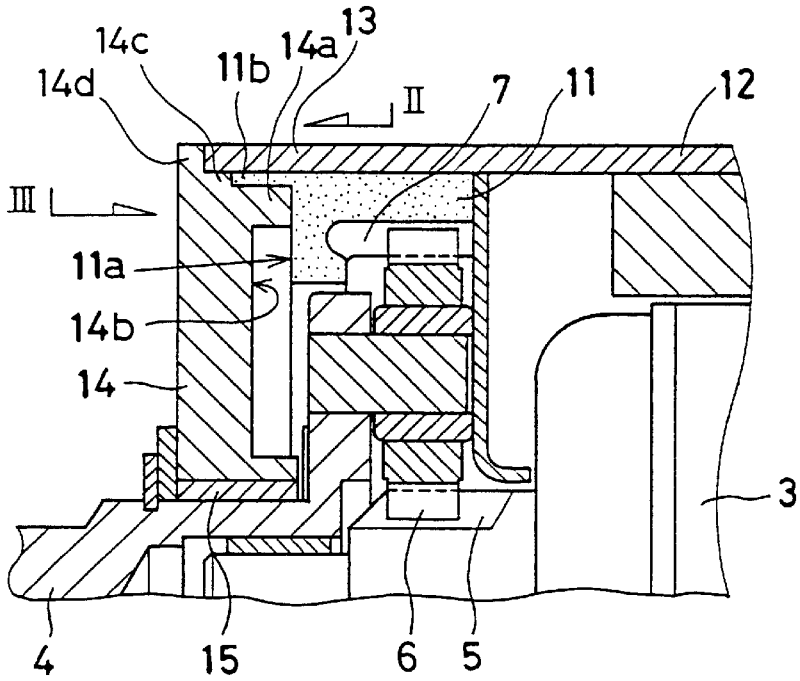
FIG. 4 is a cross-sectional view of the speed reduction mechanism of a starter according to a first embodiment of the invention.

As shown in FIGS. 2 and 4, a first step 14*c* is formed at one step lower than the base step 14*b*, and a second step 14*d* is formed outside the first step 14*c*. The first step 14*c* is thinner than the axial thickness of the spline teeth 14*a*, and the second step 14*d* is thinner than the first step 14*c*. They are formed all over the periphery of the casing 14.

The spline teeth 14*a* form the above-said rotation stopper together with the spline grooves 11*c*. The internal gear block 11 is prevented from rotating when the teeth 14*a* and the grooves 11*c* are fitted to each other.

The casing 14 and the outer cylindrical member 13 are assembled so that an open end of the outer cylindrical member 13 abuts the second step 14*d* of the casing 14.

The axial end of the cylindrical projection 11*b* of the internal gear block 11 is fitted to the periphery of the first step 14*c* of the casing 14, and the spline teeth 14*a* are fitted to the spline grooves 11*c*.

Figure 5:
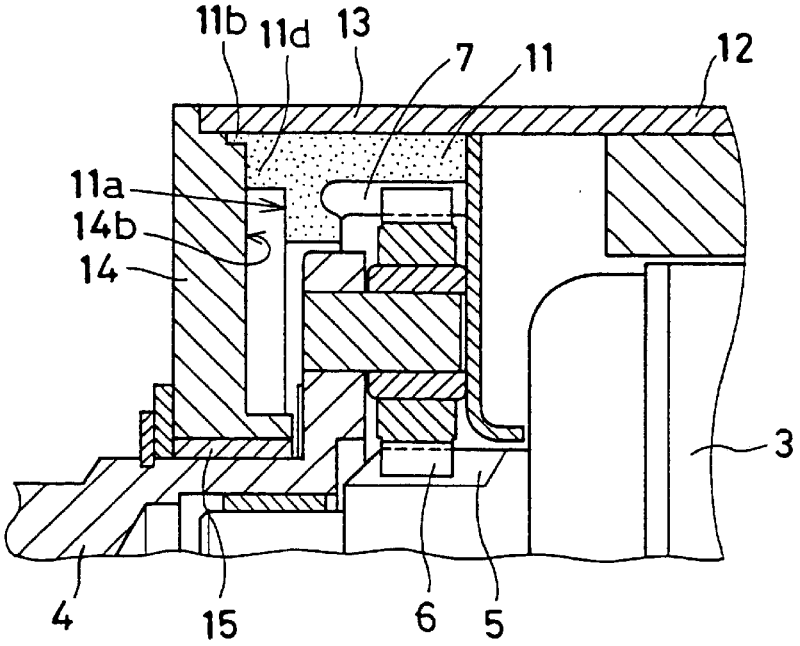
FIG. 5 is a cross-sectional view of the speed reduction mechanism of the starter according to the first embodiment of the invention.

As shown in FIG. 4, the edge of the spline teeth 14*a* and the bottom of the spline grooves 11*c* abut each other to form a rotation stopper. On the other hand, the base step 14*b* of the casing and the end surface of the medium portions lid of the internal gear block 11 abut each other, as shown in FIG. 5.

Thus, the casing 14 and the internal gear block 11 can be connected by a surface spline-connection. Therefore, a labyrinth can be formed between the casing 14 and the internal gear block 11. As a result, the casing 14 and the internal gear block 11 can be made water-tight so that the output shaft 15 and other members can be free from water.

In summary, the rotation stopper can be disposed at a portion away from the internal gear 7 so that the rotation stopper does not overlap the internal gear. Therefore, deformation of the rotation stopper does not cause trouble with the internal gear 7.

Figure 6:
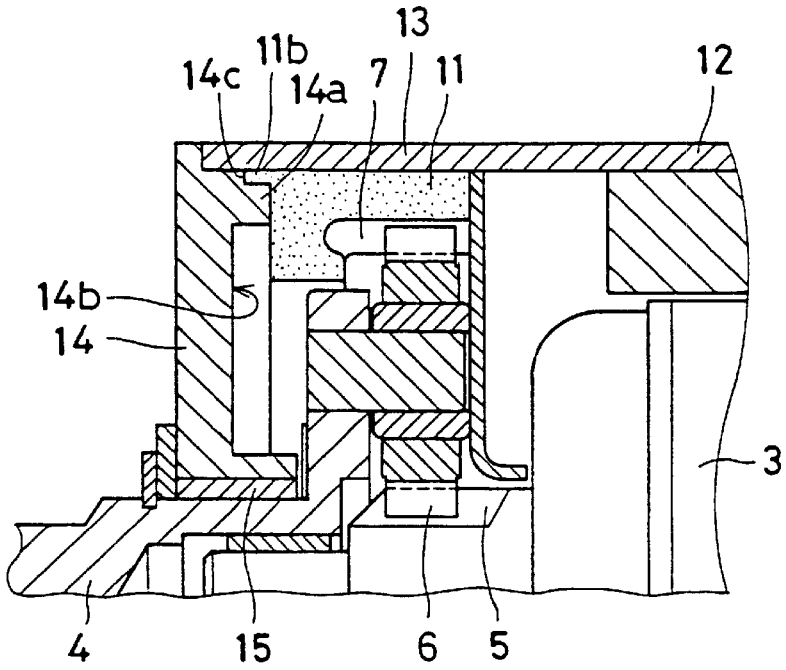
FIG. 6 is a cross-sectional view of the speed reduction mechanism of a starter according to a second embodiment of the invention.
Figure 7:
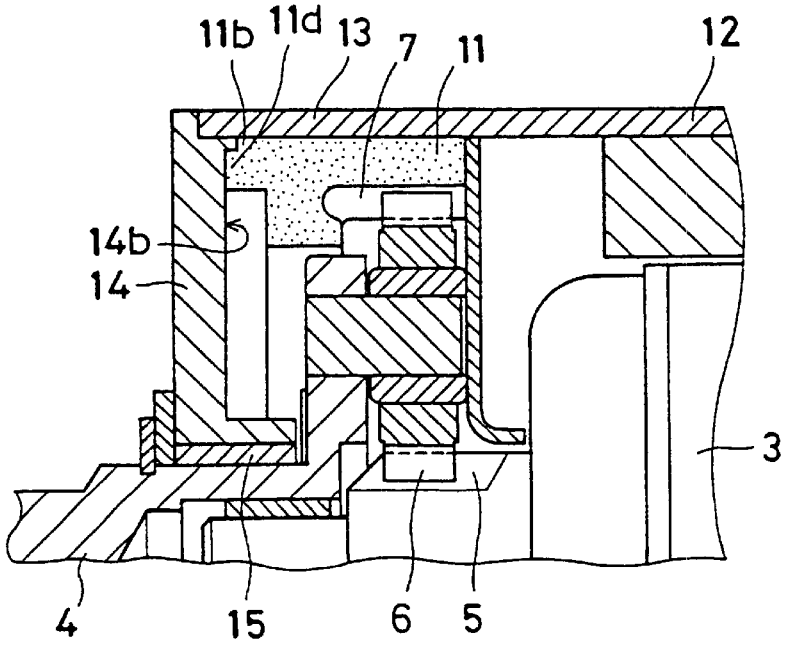
FIG. 7 is a cross-sectional view of the speed reduction mechanism of a starter according to a third embodiment of the invention.

A starter according to a second embodiment of the invention is described with reference to FIG. 6 and FIG. 7. In the meantime, the same reference numeral represents the same or substantially the same portion or component as the first embodiment hereafter.

The first step 14*c* of the casing 14 is higher than the base step 14*b*, and the medium portions 11*d* of the internal gear block 11 are higher than the spline teeth 11*b*. The same effect can be also attained by this embodiment.

Figure 8:
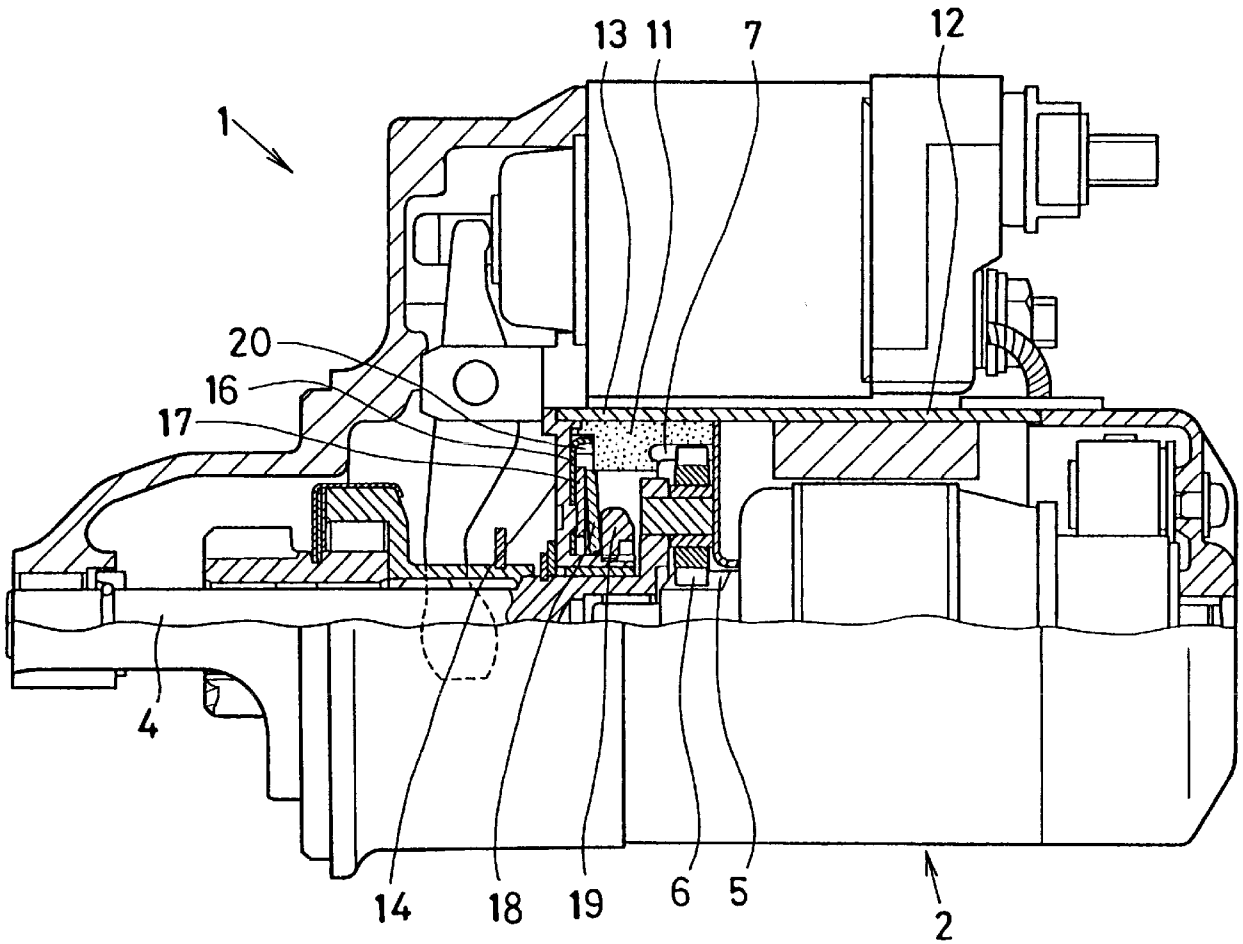
FIG. 8 is a partial cross-sectional view of the starter according to the third embodiment.
Figure 9:
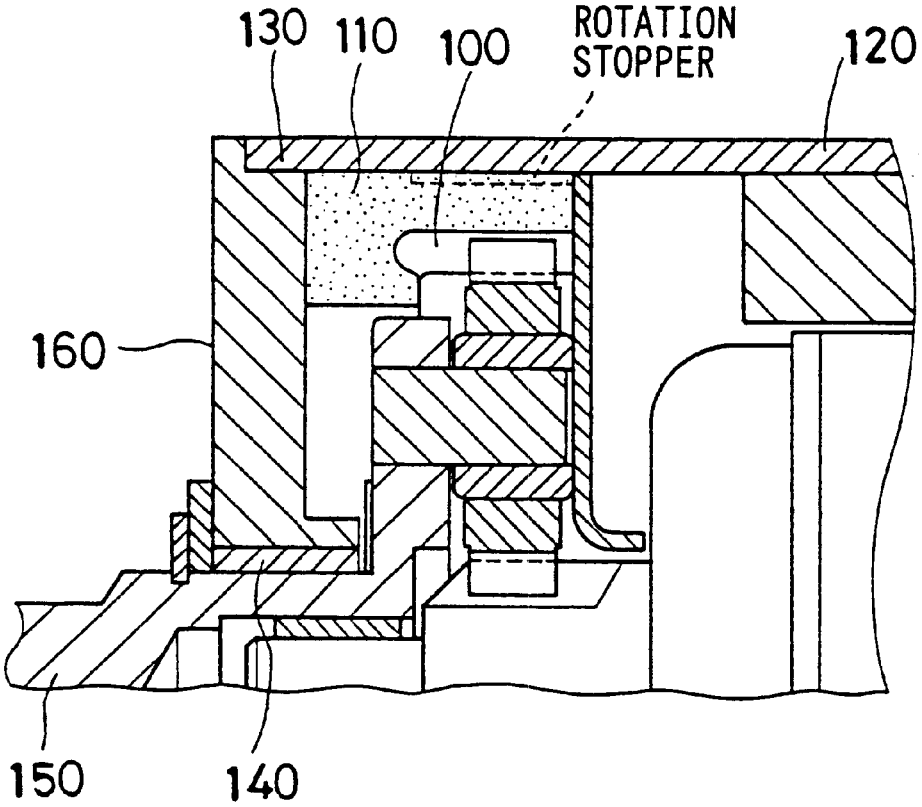
FIG. 9 PRIOR ART
FIG. 9 is a cross-sectional view of a conventional speed reduction mechanism.

A starter according to a third embodiment of the invention is described with reference to FIG. 8.

The starter 1 has a shock absorber that absorbs excessively large torque applied to the internal gear 7. The internal gear block 11 is prevented from rotating relative to a rotary disk 16 of the shock absorber.

The shock absorber is well-known member of the starter 1 and is comprised of the rotary disk 16, a stationary disk 17, a disk spring 18, an adjusting screw 19, etc. If an excessively large torque is applied to the shock absorber via the internal gear block 11, the rotary disk 16 rotates together with the internal gear block 11 to absorb the shock.

The internal gear block 11 is fitted to the periphery of the casing 14 around a rotation stopper 20 that is disposed between the internal gear block 11 and the rotary disk 16.

Therefore, a labyrinth can be formed at a portion where the casing 14 and the internal gear block 11 are connected. Therefore, the casing 14 and the internal gear block 11 can be water tightly sealed.

As a result, the lifetime of the shock absorber can be increased. In particular, the above stated structure prevents water from covering the shock absorber very effectively.

The outer cylindrical member 13 may be integrated with the casing 14, which is assembled to the yoke 12.

In the foregoing description of the present invention, the invention has been disclosed with reference to specific embodiments thereof. It will, however, be evident that various modifications and changes may be made to the specific embodiments of the present invention without departing from the scope of the invention as set forth in the appended claims. Accordingly, the description of the present invention is to be regarded in an illustrative, rather than a restrictive, sense.

What is claimed is:

1. A starter, comprising:

a starter motor generating torque at an armature thereof;

a planetary gear speed reduction mechanism including a sun gear, a plurality of planetary gears, an internal gear and an output shaft, said speed reduction mechanism increasing said torque and transmitting increased torque to said output shaft;

a casing rotatably supporting said output shaft via a bearing; and an outer cylindrical member having an open end in contact with a peripheral portion of said casing; wherein said planetary gear speed reduction mechanism has an internal gear block having said internal gear;

said internal gear block has a smooth outer cylindrical surface in contact with an inner cylindrical surface of said cylindrical member and an end surface that is perpendicular to said outer cylindrical surface and is spline-fitted to said casing, thereby forming a labyrinth between said internal gear block and said casing.

2. The starter according to claim 1, wherein said internal gear block is prevented from rotating by a rotation stopper disposed between the said internal block and said casing.

3. The starter according to claim 1 further comprising:

a shock absorber having a rotary disk that rotates when a torque larger than a predetermined torque is applied thereto, wherein said internal gear block is prevented from rotating by a rotation stopper between said internal gear block and said rotary disk.

4. The starter according to claim 1, wherein said outer cylindrical member is integrated with said casing and assembled to said yoke of said starter motor in the axial direction thereof.

5. The starter according to claim 1, wherein said outer cylindrical member is an elongation of said yoke of said starter motor and assembled into said casing.

6. A starter, comprising:

a starter motor generating torque at an armature thereof;

a planetary gear speed reduction mechanism including a sun gear, a plurality of planetary gears, an internal gear and an output shaft;

a casing rotatably supporting said output shaft via a bearing; and an outer cylindrical member, disposed in contact with said casing; wherein said planetary gear speed reduction mechanism has an internal gear block having said internal gear;

said internal gear block is prevented from rotating by a rotation stopper disposed between said internal gear block and said casing, and said rotation stopper comprises spline teeth formed at said casing and spline grooves formed at said internal gear lock.

7. A starter, comprising:

a starter motor;

a pinion;

a planetary gear speed reduction mechanism, disposed between said starter motor and said pinion, for transmitting increased torque of said starter motor to said pinion, said speed reduction mechanism including a sun gear, a plurality of planetary gears, an internal gear and an output shaft;

a casing rotatably supporting said output shaft; and an outer cylindrical member coupled with said casing for accommodating said planetary gear speed reduction mechanism together with said casing; wherein said planetary gear speed reduction mechanism comprises an internal gear block having a periphery fitted to said cylindrical member and said internal gear therein; and a surface spline arrangement is disposed generally perpendicular to said periphery of said internal gear block between said internal block and said casing so that said internal gear block is spline-fitted to said casing, thereby forming a labyrinth between said internal gear block and said casing.

8. A starters, comprising:

a starter motor;

a pinion;

a planetary gear speed reduction mechanism, disposed between said starter motor and said pinion, for transmitting increased torque of said starter motor to said pinion, said speed reduction mechanism including a sun gear, a plurality of planetary gears, an internal gear block having an internal gear therein and an output shaft connected to said plurality of planetary gears;

a casing rotatably supporting said output shaft; and an outer cylindrical member coupled with said casing for accommodating said planetary gear speed reduction mechanism together with said casing; and a surface spline arrangement disposed approximately perpendicular to said periphery of said internal gear block between said internal gear block and said casing so that said internal gear block is spline-fitted to said casing, thereby forming a labyrinth between said internal gear block and said casing.

9. The starter as claimed in claim 1, wherein said casing has a first step and a second step formed on said peripheral portion thereof in contact with said open end of said outer cylindrical member.

* * * * *